US007425084B2

(12) United States Patent
Ruud et al.

(10) Patent No.: US 7,425,084 B2
(45) Date of Patent: Sep. 16, 2008

(54) BOLLARD LUMINAIRE

(75) Inventors: Alan J. Ruud, Racine, WI (US); Kurt Wilcox, Libertyville, IL (US); Steven R. Walczak, Hales Corner, WI (US)

(73) Assignee: Ruud Lighting, Inc., Racine, WI (US)

( * ) Notice: Subject to any disclaimer, the term of this patent is extended or adjusted under 35 U.S.C. 154(b) by 8 days.

(21) Appl. No.: 11/541,907

(22) Filed: Sep. 30, 2006

(65) Prior Publication Data

US 2008/0080192 A1 Apr. 3, 2008

(51) Int. Cl.
*F21V 7/00* (2006.01)

(52) U.S. Cl. ..... 362/298; 362/245

(58) Field of Classification Search ..... 362/152, 362/227, 238, 240, 241, 245, 294, 297, 298, 362/305, 327, 328, 329, 331, 346, 347, 351, 362/373, 431

See application file for complete search history.

(56) References Cited

U.S. PATENT DOCUMENTS 1,663,386 A * 3/1928 Rice ..... 40/564
4,084,215 A * 4/1978 Willenbrock ..... 362/470
4,826,273 A * 5/1989 Tinder et al. ..... 362/488
6,086,218 A * 7/2000 Robertson ..... 362/157
6,533,446 B2 * 3/2003 Chen et al. ..... 362/559
7,083,315 B2 * 8/2006 Hansler et al. ..... 362/559
2006/0044814 A1 * 3/2006 Ikeda ..... 362/382
2006/0083017 A1 * 4/2006 Wang et al. ..... 362/547
2006/0176702 A1 * 8/2006 Shen et al. ..... 362/311
2006/0285332 A1 * 12/2006 Goon et al. ..... 362/327

* cited by examiner

*Primary Examiner*—Hargobind S Sawhney
(74) *Attorney, Agent, or Firm*—Jansson Shupe & Munger Ltd.

(57) ABSTRACT

A bollard luminaire comprising a ground-mountable tubular vertical housing having a base portion and an upper portion, an annular lens member atop the housing in substantial axial alignment therewith, an upper reflector at the top of the lens member directing and reflecting light through the annular lens member, the housing and lens member being configured and the upper reflector positioned such that it receives upwardly directed light from below, and an LED module inside the base portion of the housing, the LED module being substantially centrally positioned, oriented for upward light emission, and having LED/optical-element sets themselves providing substantially vertically collimated light. In preferred embodiments, the housing is light-transmissive.

19 Claims, 8 Drawing Sheets

SECTION B-B

BOLLARD LUMINAIRE

FIELD OF THE INVENTION

This invention relates generally to lighting devices for area illumination, and more particularly, to bollard luminaires.

BACKGROUND OF THE INVENTION

Bollard luminaires are popularly used in countless commercial applications as a natural choice for ground illumination. Traditional bollard luminaires typically include a tubular housing that is opaque. This choice is necessitated in part by virtue of the type of light source seen in traditional bollard luminaires and also by the traditional reflector systems used. Typically, standard bollards feature fluorescent, metal halide, or high pressure sodium lamps. These types of lamps generate significant heat within the tubular housing that would prevent the use of a housing made of light-transmissive material. Typical bollard luminaires generally also include a main reflector (which is sometimes part of the lamp and other times a separate element) and an upper reflector.

While a vast number of bollard luminaire options exist, there exists a need for a bollard luminaire of the type that allows for a light-transmissive housing. Such a light fixture should also be configured to provide a light source that would allow for the use of a housing that is of a light-transmissive material. It would further be desired to configure the bollard luminaire to take advantage of the light-transmissive housing as a display area for an image to be viewed from outside of the housing.

OBJECTS OF THE INVENTION

It is an object of the invention to provide a bollard luminaire having a light-transmissive housing.

Another object of the invention is to provide a bollard luminaire having a light source that will accommodate a housing that is made of a light-transmissive material.

Another object of the invention is to provide a bollard luminaire for use in a variety of commercial and marketing-type applications.

Still another object of the invention is to provide a bollard luminaire that includes only one reflector.

Yet another object of the invention is to provide a bollard luminaire having improved efficiency and product life.

Another object of the invention is to provide a bollard luminaire having improved lower temperature operation.

Still another object of the invention is to provide a bollard luminaire having a simplified construction.

How these and other objects are accomplished will become apparent from the following descriptions and the drawings.

SUMMARY OF THE INVENTION

The present invention provides a bollard luminaire designed for use in a myriad of commercial and advertising applications. The invention, which will be described in further detail below, includes an LED module having individual LED/optical-element sets that provide substantially vertically-collimated light. In preferred embodiments, the invention includes a light-transmissive housing which allows for an image to be displayed and viewable from the outside of the housing. In order for it to be possible to use a housing that is of light-transmissive material, the invention further includes an LED module as the light source.

The invention, as disclosed, is a bollard luminaire that includes a ground-mountable tubular vertical housing having a base portion and an upper portion. An annular lens member is positioned atop the housing in substantial axial alignment therewith. The inventive bollard luminaire further includes an upper reflector at the top of the lens member that both directs and reflects light through the annular lens member. The housing and lens member are configured and the upper reflector is positioned such that the upper reflector receives upwardly directed light from below. The bollard luminaire also includes an LED module inside the base portion of the housing. The LED module is substantially centrally positioned, oriented for upward light emission, and has LED/optical-element sets which themselves provide substantially vertically-collimated light. In preferred embodiments, the housing is light-transmissive. In highly preferred embodiments, the housing is a display area adapted to show an image viewable from outside the housing.

In addition to the commercial and marketing advantages provided by this invention, another advantage of this invention is that it allows for the use of less expensive polymeric materials to be used for the housing. By providing a bollard luminaire having an LED module, the housing may be made of a variety of polymeric materials which heretofore would not have been options in conjunction with standard light sources used in bollard luminaires. Also, whether or not the light-transmissive housing is used to display an image, the light-transmissive housing itself provides a unique alternative in bollard luminaires and a distinctive look. Yet another advantage of this present invention is to simplify the construction of the bollard luminaire by not requiring two reflectors. Rather, the use of an LED module as a light source requires only an upper reflector to receive and reflect light. Another advantage is that by using an LED module, the inventive bollard luminaire has improved efficiency and a longer product life than bollards of the art.

As used herein, the term "substantially vertically collimated" means the light from each of the LED/optical-element sets is predominantly directly upward with no more than minimal angular deviation from vertical. In the absence of the light being substantially vertically collimated, LED/optical-element sets would provide angular spread. In other words, the LED/optical-element sets are particularly tailored so that the predominant amount of light is vertical or close to vertical.

As used herein, the term "footprint" means the area taken up by the LED module.

DETAILED DESCRIPTION OF PREFERRED EMBODIMENTS

Figure 1:
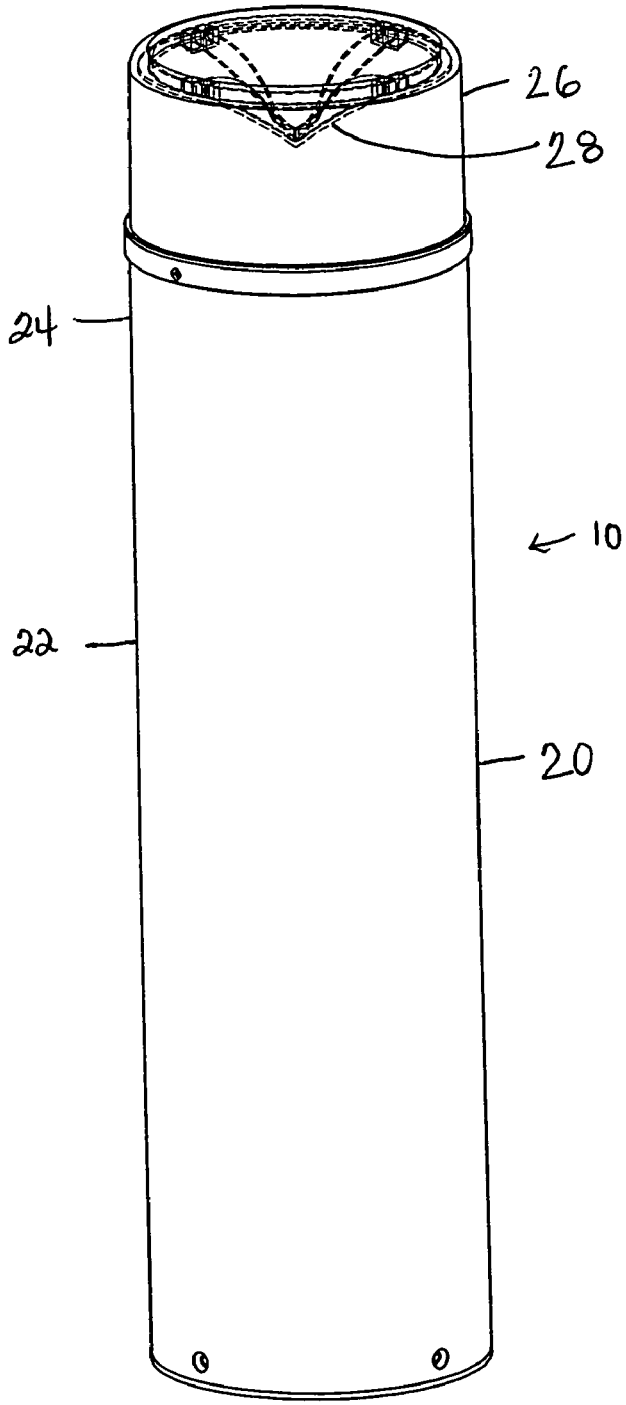
FIG. 1 is an elevation perspective view of the inventive bollard luminaire.

FIGS. 1-8 illustrate preferred embodiment of the inventive bollard luminare 10 having a ground-mountable tubular vertical housing 20 having a base portion 22 and an upper portion 24, an annular lens member 26 atop housing 20 in substantial axial alignment therewith, an upper reflector 28 at the top of lens member 26 directing and reflecting light through annular lens member 26, housing 20 and lens member 26 being configured and upper reflector 28 positioned such that it receives upwardly directed light from below, and an LED module 30 inside base portion 22 of housing 20, LED module 30 being substantially centrally positioned, oriented for upward light emission, and having LED/optical-element sets 32 themselves providing substantially vertically-collimated light.

Figure 2:
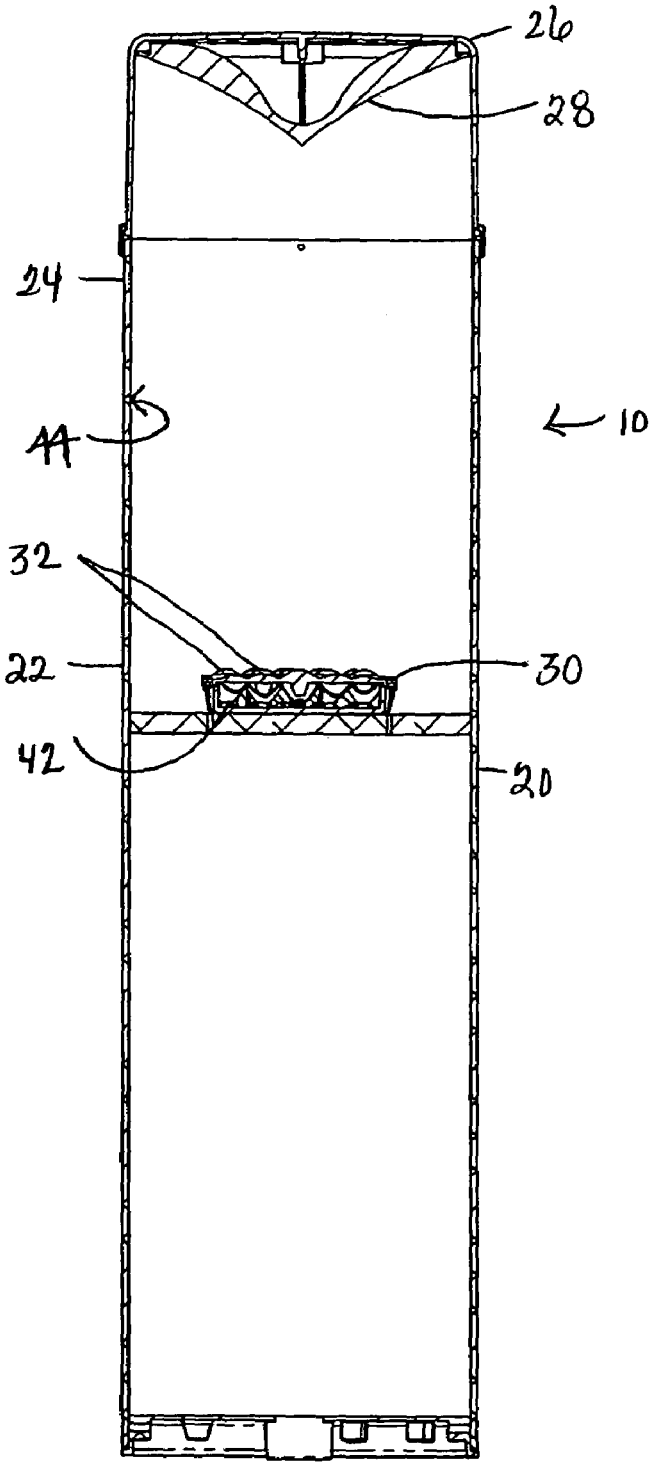
FIG. 2 is a cross-sectional side elevation view of the luminaire of FIG. 1 taken along a plane coincident with the central vertical axis thereof, with portions shown in dotted outline.
Figure 3:
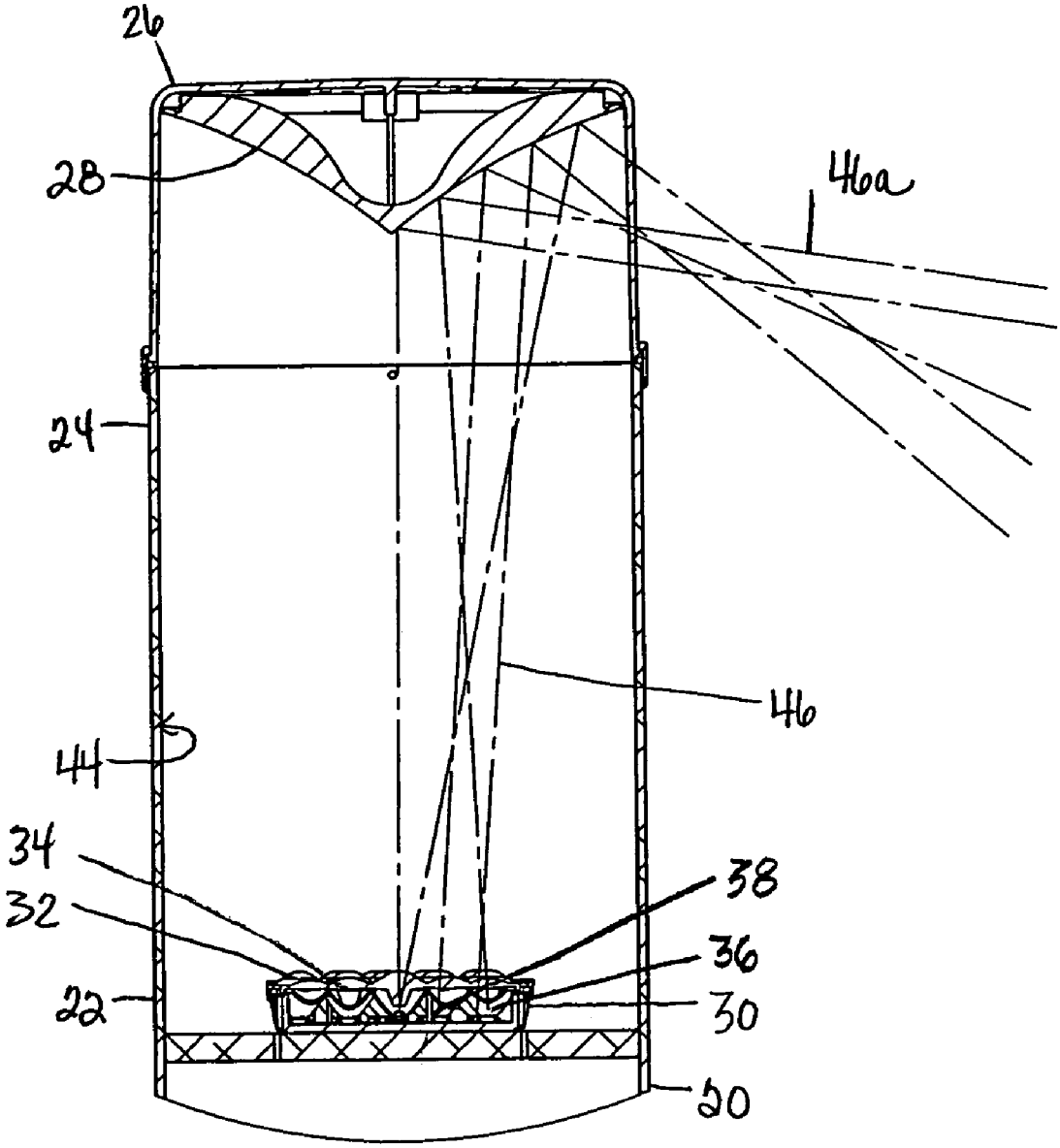
FIG. 3 is a representative partial ray trace of the luminaire of FIG. 1

As best seen in FIGS. 2 and 3, LED/optical-element sets 32 include an LED 34 and a reflector 36. LED 34 and reflector 36 are rigidly affixed with respect thereto. In another embodiment, LED/optical element sets 32 include LED 34 and a refractor 38. LED 34 and refractor 38 are rigidly affixed thereto. In such embodiments, the LED/optical-element set further includes as least an LED and a reflector, the LED and reflector rigidly affixed with respect thereto.

In most highly preferred embodiments and as seen in FIGS. 2 and 3, LED module 30 has an adjoining heat sink 42 positioned below LED module 30 to dissipate heat away from LED module 30.

Figure 5:
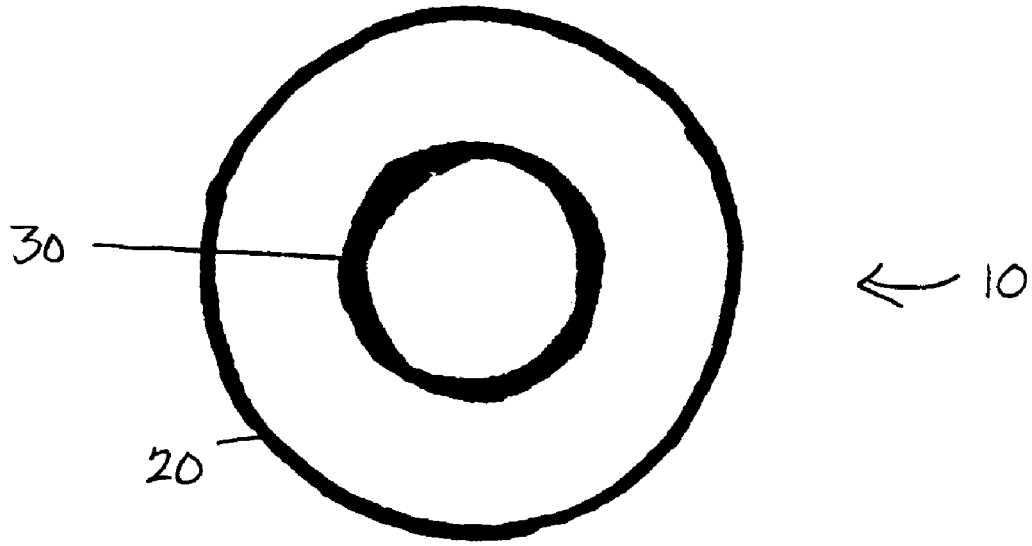
FIG. 5 is a schematic of the bollard luminaire of FIG. 1, having the top portion of the bollard removed to show in a top plan view the footprint of the LED module relative to the housing.

FIG. 5 illustrates that LED module 30 has a footprint 40 that is substantially concentric with housing 20. In certain embodiments, footprint 40 is substantially circular. LED module 30 is preferably configured of a diameter equal to at least half the diameter of housing 20. In more preferred embodiments, LED module 30 has a diameter of at least 70% the diameter of housing 20, whereby LED module 30 covers an area in excess of about one-half the area of housing 20.

Figure 6:
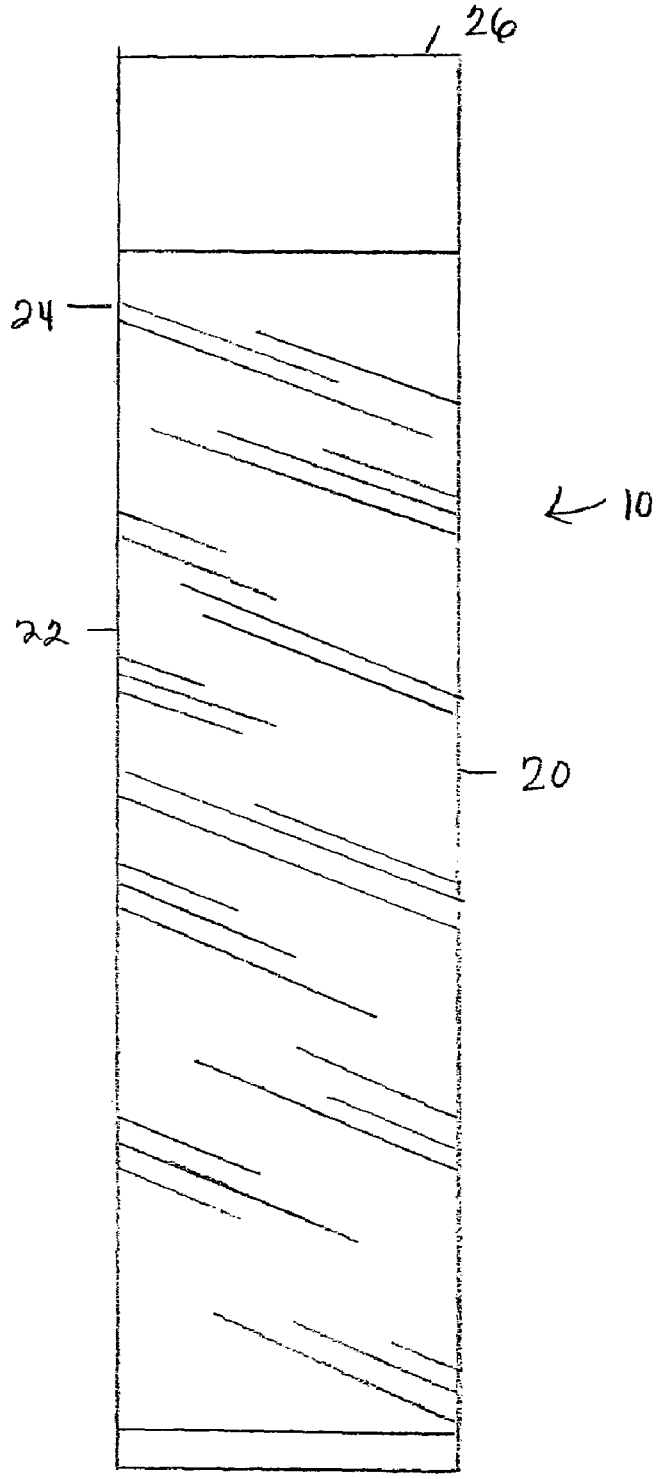
FIG. 6 is an embodiment of the inventive bollard luminaire having a light-transmissive housing.
Figure 7:
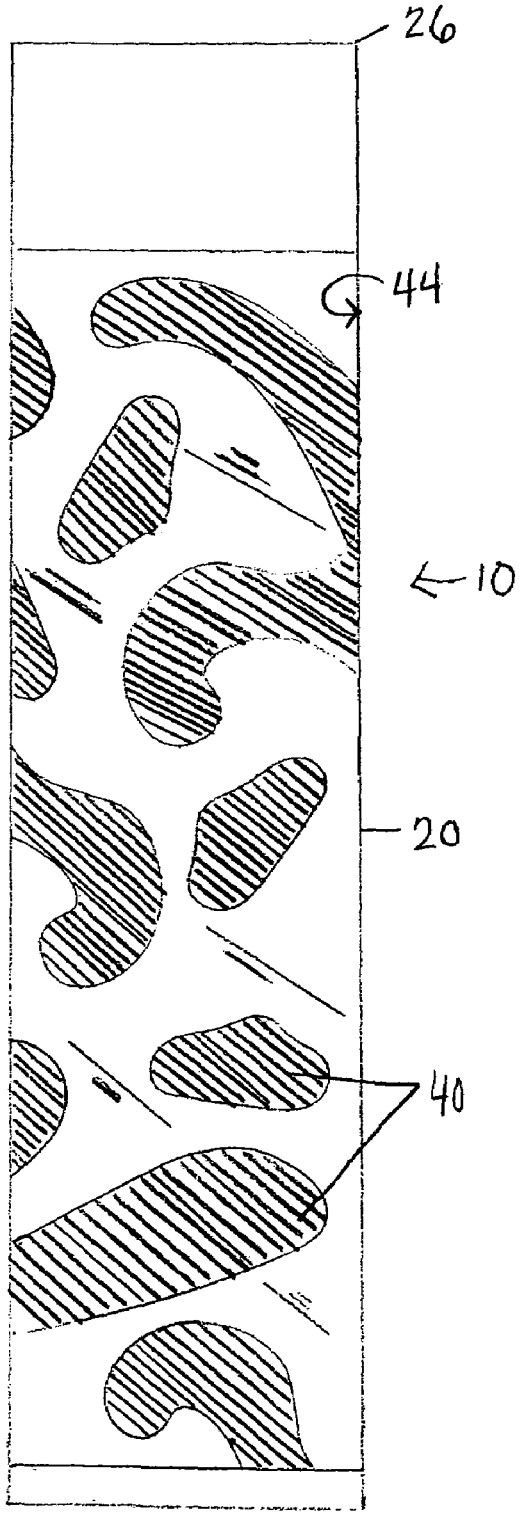
FIG. 7 is an preferred embodiment of the bollard luminaire of FIG. 6, where the housing is a display area having a lit image.
Figure 8:
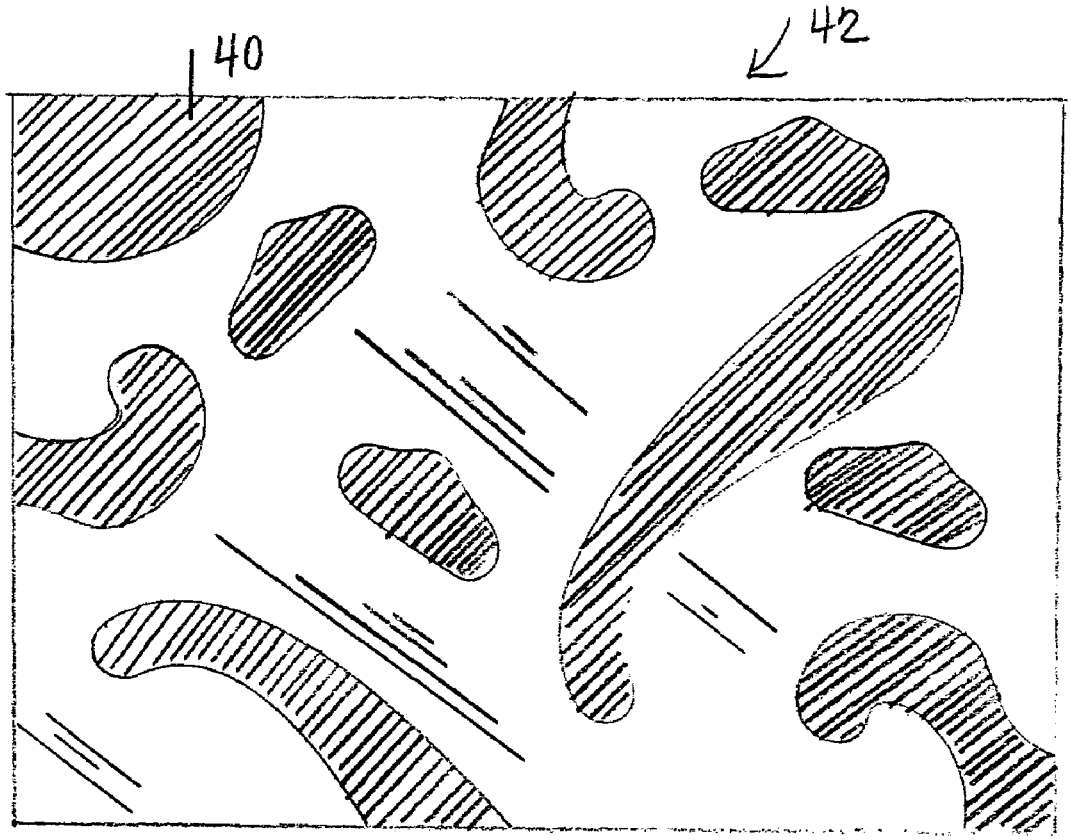
FIG. 8 is a schematic of a portion of the bollard luminare of FIG. 7, showing the light-transmissive sheet and image thereon.

Most preferably and as illustrated in FIGS. 6 and 7, housing 20 is light-transmissive. In preferred embodiments, housing 20 is of polymeric materials. The polymeric material is one of acrylic, polycarbonate, polystyrene, or copolymers thereof. In such preferred embodiments, annular lens member 26 is integrally formed with light-transmissive housing 20. FIG. 7 shows housing 20 is a display area adapted to show a lit image 40 viewable from outside of housing 20. FIG. 8 illustrates that image 40 is on a light-transmissive sheet 42 against and conformed to the inside surface 44 of light-transmissive housing 20. Light-transmissive sheet 42, when not inserted against the inside surface of the housing, is substantially planar to facilitate application of image 40 thereon. In additional to the substantially vertically collimated light, LED/optical-element sets 32 allow some off-vertical light to enhance image 40 viewable from outside of the housing.

FIG. 3 is a partial "ray trace" of the bollard luminaire. It shows further that in addition to the substantially vertically collimated light, some light is angled to enhance image 40 viewable from outside housing 20. Rays 46 from the light source strike the elliptical surface of upper reflector 28 and are reflected laterally outward from the surface of upper reflector 28. The reflected light identified as 46*a* and laterally directed through lens element 26 is greatest at an angle about 70° from vertical, thereby providing illumination over a broad 360° area.

Figure 4:
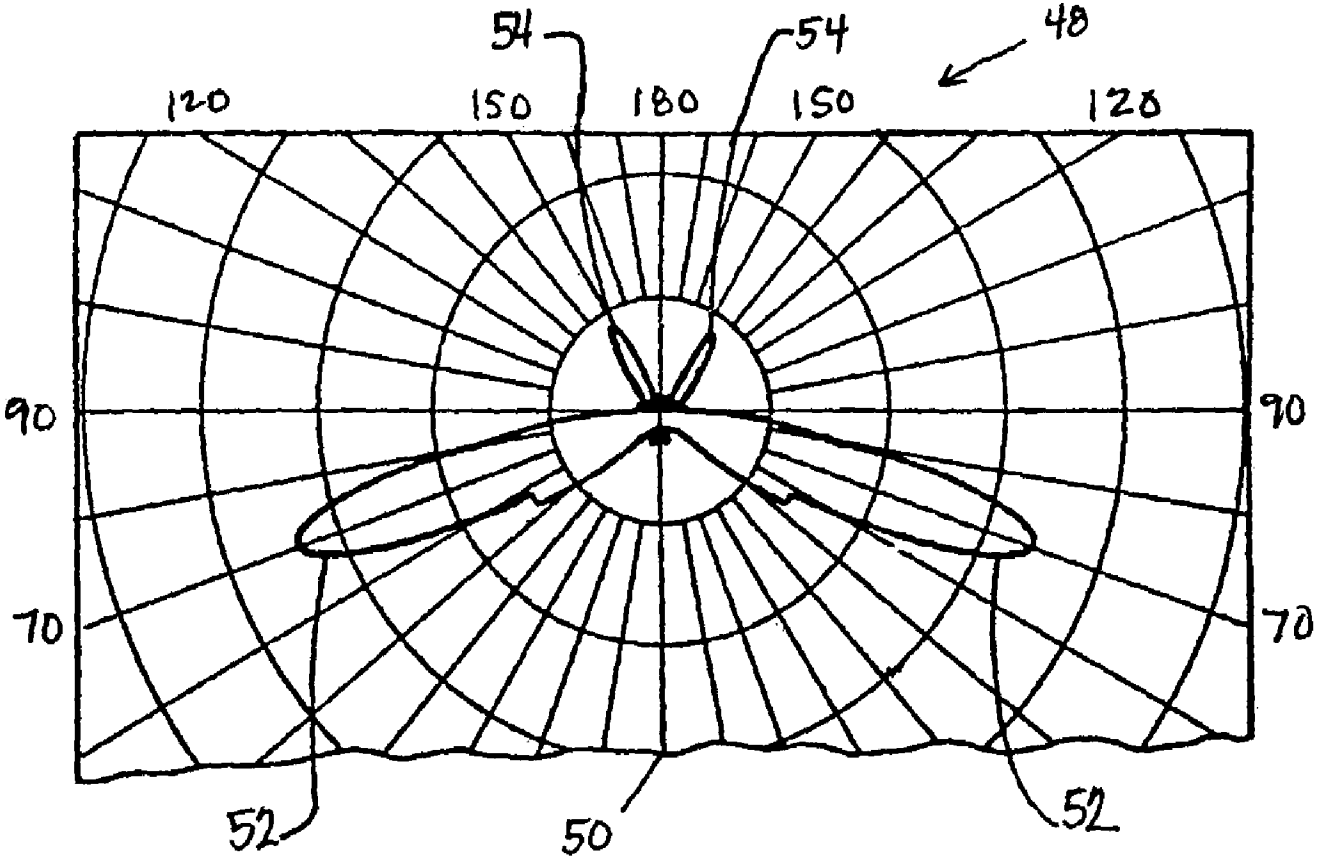
FIG. 4 is a candlepower trace in the vertical plane of the light pattern of the luminaire of FIG. 1.

FIG. 4 is known as a candlepower trace 48 in the vertical plane. That is, it is a view normal to a vertical plane which includes the central longitudinal axis 50 of bollard luminaire 10. Such trace 48 shows the pattern of light emitted by luminaire 10. It will be noted there is a lobe 52 at about 70° from vertical and such lobe 52 results from the rays emitted near the annular edge. It is also noted there is a small upwardly-directed lobe 54 which results from rays emitted near the annular edge. It is to be appreciated that, in actuality, lobe 52 is symmetrical about axis 50 and somewhat umbrella-shaped. Lobe 54 is likewise symmetrical about such axis 39 and shaped somewhat like an upstanding, wide-mouthed cup.

While the principles of the invention have been shown and described in connection with specific embodiments, it is to be understood that such embodiments are by way of example and are not limiting.

We claim:

1. A bollard luminaire comprising a ground-mountable tubular vertical light-transmissive housing having a base portion and an upper portion, an annular lens member atop the housing in substantial axial alignment therewith, an upper reflector at the top of the lens member-directing and reflecting light through the annular lens member, the housing and lens member being configured and the upper reflector positioned such that it receives upwardly directed light from below, and an above-ground LED module inside the base portion of the housing, the LED module being substantially centrally positioned, oriented for upward light emission, and having LED/optical-element sets themselves providing substantially vertically-collimated light.

2. The bollard luminaire of claim 1 wherein an LED/optical-element set includes at least an LED and a reflector, said LED and reflector rigidly affixed with respect thereto.

3. The bollard luminaire of claim 1 wherein an LED/optical-element set includes at least an LED and a refractor, said LED and refractor rigidly affixed with respect thereto.

4. The bollard luminaire of claim 3 wherein an LED/optical-element set further includes at least an LED and a reflector, said LED and reflector rigidly affixed with respect thereto.

5. The bollard luminaire of claim 1 wherein the LED module has an adjoining heat sink positioned below the LED module to dissipate heat away from the LED module.

6. The bollard luminaire of claim 1 wherein the LED module has a footprint that is substantially concentric with the housing.

7. The bollard luminaire of claim 6 wherein the footprint is substantially circular.

8. The bollard luminaire of claim 7 wherein the LED module is configured of a diameter equal to at least half the diameter of the housing.

9. The bollard luminaire of claim 8 wherein the LED module has a diameter of at least about 70% the diameter of the housing, whereby the LED module covers an area in excess of about one-half the area of the housing.

10. The bollard luminaire of claim 1 wherein the housing is of a polymeric material.

11. The bollard luminaire of claim 10 wherein the polymeric material is one of acrylic, polycarbonate, polystyrene, or copolymers thereof.

12. The bollard of claim 10 wherein the annular lens member is integrally formed with the light-transmissive housing.

13. The bollard luminaire of claim 12 wherein the housing is a display area adapted to show a lit image viewable from outside of said housing.

14. The bollard luminaire of claim 13 wherein the image is on a light-transmissive sheet against and conformed to the inside surface of the light-transmissive housing.

15. The bollard luminaire of claim 14 wherein the light-transmissive sheet, when not inserted against the inside surface of the housing, is substantially planar to facilitate application of the image thereon.

16. The bollard luminaire of claim 13 wherein, in addition to the substantially vertically collimated light, the LED/optical-element sets allow some off-vertical light to enhance the image viewable from outside of the housing.

17. A bollard luminaire comprising a ground-mountable tubular vertical light-transmissive housing adapted to show a lit image viewable from outside of the housing and having a base portion and an upper portion, an annular lens member atop the housing in substantial axial alignment therewith, an upper reflector at the top of the lens member-directing and reflecting light through the annular lens member, the housing and lens member being configured and the upper reflector positioned such that it receives upwardly directed light from below, and an above-ground LED module inside the base portion of the housing, the LED module being substantially centrally positioned, oriented for upward light emission, and having LED/optical-element sets themselves providing substantially vertically-collimated light.

18. The bollard luminaire of claim 17 wherein, in addition to the substantially vertically collimated light, the LED/optical-element sets allow some off-vertical light to enhance the image viewable from outside of the housing.

19. The bollard luminaire of claim 17 wherein an LED/optical-element set includes at least an LED and a reflector, said LED and reflector rigidly affixed with respect thereto.

* * * * *